US006368671B1

(12) United States Patent
McCormick

(10) Patent No.: US 6,368,671 B1
(45) Date of Patent: Apr. 9, 2002

(54) TREATING SOLID, ESPECIALLY ALUMINUM, SURFACES

(76) Inventor: David R. McCormick, 1322 N. Custer Ave., Clawson, MI (US) 48017

( * ) Notice: Subject to any disclaimer, the term of this patent is extended or adjusted under 35 U.S.C. 154(b) by 0 days.

(21) Appl. No.: 09/720,322

(22) PCT Filed: Jun. 22, 1998

(86) PCT No.: PCT/US99/12812

§ 371 Date: Dec. 22, 2000

§ 102(e) Date: Dec. 22, 2000

(87) PCT Pub. No.: WO99/67029

PCT Pub. Date: Dec. 29, 1999

Related U.S. Application Data

(60) Provisional application No. 60/090,205, filed on Jun. 22, 1998.

(51) Int. Cl.[7] ..... B05D 1/36; B05D 7/16

(52) U.S. Cl. ..... 427/409; 427/419.1; 148/240; 148/243; 148/275

(58) Field of Search ..... 427/409, 419.1; 148/240, 243, 275

(56) References Cited

U.S. PATENT DOCUMENTS

| | | | | |
|---|---|---|---|---|
| 4,433,015 A | | 2/1984 | Lindert | 427/388.4 |
| 4,517,028 A | | 5/1985 | Lindert | 148/6.14 R |
| 4,944,812 A | * | 7/1990 | Lindhert et al. | 148/251 |
| 4,963,596 A | | 10/1990 | Lindert et al. | 526/313 |
| 4,970,264 A | | 11/1990 | Lindert et al. | 525/328.8 |
| 5,039,770 A | | 8/1991 | Lindert et al. | 526/312 |
| 5,063,089 A | | 11/1991 | Lindert et al. | 427/354 |
| 5,068,299 A | | 11/1991 | Lindert et al. | 526/313 |
| 5,116,912 A | | 5/1992 | Lindert et al. | 525/340 |
| 5,250,325 A | * | 10/1993 | Phillips et al. | 427/386 |
| 5,266,410 A | | 11/1993 | Lindert et al. | 428/461 |
| 5,298,289 A | | 3/1994 | Lindert et al. | 427/388.4 |
| 5,356,490 A | | 10/1994 | Dolan et al. | 148/247 |
| 5,891,952 A | | 4/1999 | McCormick et al. | 524/596 |

* cited by examiner

*Primary Examiner*—Erma Cameron
(74) *Attorney, Agent, or Firm*—Stephen D. Harper

(57) ABSTRACT

To improve at least one of the hydrophilicity, corrosion resistance, and adhesion by subsequently applied paints, a solid surface, preferably an aluminum alloy surface, is treated with an initial treatment liquid that comprises water and dissolved, dispersed or both dissolved and dispersed polymers that include substantial mass fractions of benzene rings that are substituted with at least one oxygen atom and at least one substituted aminomethylene moiety on each ring, and then treated with a secondary treatment liquid that comprises water and vanadate anions.

20 Claims, No Drawings

TREATING SOLID, ESPECIALLY ALUMINUM, SURFACES

This application claims the benefit of No. 60/090,205 filed Jun. 22, 1998.

FIELD AND BACKGROUND OF THE INVENTION

This invention relates to a process for treating a solid surface with two successive distinct treatment liquids in order to improve at least one of the hydrophilicity of the surface, its corrosion resistance, and the adhesion to the treated surface by subsequently applied paints. The solid surface treated is preferably a metallic surface and more particularly a surface of aluminum or one of its alloys that contains at least 50 atomic percent of aluminum, all of these being hereinafter included within the meaning of the word "aluminum" and, *mutatis mutandis,* within the meaning of any grammatical variations of this word. The treatment compositions do not require hexavalent chromium but are capable of providing a quality of treated surface as good as that achieved in the past by treatments that did use hexavalent chromium, which is increasingly undesirable because of its adverse environmental impact. The invention is particularly advantageously applicable to provide aluminum evaporators, heat exchangers, and condensers with hydrophilic coatings that have good corrosion resistance and little or no tendency to develop undesirable odors during use.

Although any of the common structural metals can be used in constructing practical heat exchanging surfaces, aluminum and its alloys are among those most often used, because of their high heat conductivity. In heat exchanger surfaces, metals are normally used without any relatively thick protective coating such as a paint or lacquer that would generally be used in other types of equipment made from metals and exposed to corrosive environments, to improve the resistance of the equipment, but any such relatively thick protective coating is avoided in heal exchangers because such a coating would also reduce the efficiency of heat exchange.

During the cooling of hot air, a common use of these heat exchangers, moisture contained as vapor in the hot air condenses and initially forms water drops or beads on the fins of the heat exchanger. If the surface of the heat exchanger fins is not sufficiently hydrophilic, these water beads accumulate on the fin surface and tend to bridge across the small spaces between fins, thereby impeding the air flow between fins and reducing the heat transfer efficiency. The condensed water beads also tend to absorb dust and contaminants in the air, such as carbon dioxide, nitrogen oxides, and sulfur oxides, which can promote corrosion of the underlying aluminum, and because of the capillary forces holding in place water drops that have grown sufficiently large to bridge between adjacent fins, the normal drainage of water away from the fins that would otherwise carry away these absorbed contaminants is substantially reduced. Therefore, the formation of water beads on the fins of an aluminum heat exchanger not only decreases heat transfer efficiency but also can physically damage the exchanger.

In order to achieve a desirable combination of a hydrophilic nature and corrosion resistance on metal, particularly aluminum, surfaces, various coatings and treatments have been tried, but no fully satisfactory result has yet been achieved. A chromate conversion coating without any post-treatment usually has inadequate corrosion resistance and often develops an unpleasant odor and poor hydrophilicity.

Silicate coating over a chromate conversion coat has often been used but has not satisfied all users. More recently, biocide protected hydrophilic organic polymer films have been used as post-treatments over chromate conversion coatings. While effective, these have proved to be expensive and difficult to control in some commercial operations.

Major alternative or concurrent objects of the invention are to achieve (i) a combination of adequate hydrophilicity and corrosion resistance, compared with the prior art, while minimizing the use of polluting constituents, particularly chromium, and of highly volatile constituents, particularly organic solvents, with potential toxicity or unpleasant odors for workers, in the treatment compositions, (ii) durability of the hydrophilicity under thermal aging and/or practical use, (iii) avoidance of the development of unpleasant odors during practical use of the hydrophilicized surfaces, (iv) improved corrosion resistance of the treated surface, even if it is not necessarily hydrophilic, and (v) improved adhesion of paints to the treated surfaces. Other objects will be apparent from the description below.

Except in the claims and the specific examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, unless expressly stated to the contrary: percent, "parts of", and ratio values are by weight; the term "polymer" includes "oligomer", "copolymer", "terpolymer", and the like; the first definition or description of the meaning of a word, phrase, acronym, abbreviation or the like applies to all subsequent uses of the same word, phrase, acronym, abbreviation or the like and applies, *mutatis mutandis,* to normal grammatical variations thereof; the description of a group or class of materials as suitable or preferred for a given purpose in connection with the invention implies that mixtures of any two or more of the members of the group or class are equally suitable or preferred; chemical descriptions of neutral materials apply to the materials at the time of addition to any combination specified in the description and/or of generation in situ in a combination by chemical reactions described in the specification, and do not necessarily preclude chemical changes to the materials as a result of unstated reaction in the combination; in addition, specification of materials in ionic form means that the materials are supplied to prepare the compositions containing them in the form of one or more soluble substance(s) containing the ions specified and implies the presence in any composition specified to contain ionic materials of sufficient counterions to produce electrical neutrality for the composition as a whole; any counterions thus implicitly specified preferably are selected from among other constituents explicitly specified in ionic form, to the extent possible; otherwise such counterions may be freely selected, except for avoiding counternons that act adversely to an object of the invention; the description of liquid materials as "solution" or as "homogeneous" or by any grammatical variations of these terms includes not only true thermodynamic equilibrium solution or homogeneity but also dispersions that are stable enough to avoid any separation into two or more distinct phases readily detectable by unaided normal human vision after storage without mechanical disturbance at 25° C. for at least 100, or preferably at least 1000, hours; and the term "paint" and its grammatical variations include any similar materials that might be known by more specialized names such as enamel, lacquer, varnish, shellac, radiation curable coatings, photocurable coatings, primer, top coat, electrodeposited coatings, autodeposited coatings, or the like.

BRIEF SUMMARY OF THE INVENTION

It has been found that, in one major process embodiment of the invention, an effective treatment can be achieved by successive intervals of contact with an initial treatment liquid that comprises water and dissolved, dispersed, or both dissolved and dispersed polymers that include substantial mass fractions of benzene rings that are substituted with at least one oxygen atom and at least one substituted aminomethylene moiety on each ring, followed by treatment with a secondary treatment liquid that comprises water and vanadate anions. Other embodiments of the invention include an article of manufacture comprising a surface treated according to the invention and an extended process including a simple process according to the invention along with other operations that may be conventional per se.

DETAILED DESCRIPTION OF THE INVENTION

A process according to the invention for treating a solid surface so as to transform it to an improved surface comprises, preferably consists essentially of, or more preferably consists of at least the following consecutive operations:

(I) forming a preliminarily improved surface from said solid surface by contacting said solid surface for an initial treatment time interval at at least one initial treatment temperature with an initial treatment liquid that comprises water and dissolved, dispersed, or both dissolved and dispersed polymer molecules that include substituted benzene rings that have as substituents on each ring (i) at least one oxygen atom and (ii) at least one substituted methylene moiety that in addition to its direct bond to the benzene ring is also bonded to an N-substituted amino moiety;

(II) after completion of the initial treatment time interval, discontinuing contact of the preliminarily improved surface with the initial treatment liquid except for any part thereof that may spontaneously remain adherent on said preliminarily improved surface after completion of separation of the initial treatment liquid from the preliminarily improved surface under the influence of a force that promotes separation of liquid from the preliminarily improved surface at least as strongly as does drainage under the influence of natural gravity and, optionally, rinsing the preliminarily improved surface with water;

(III) forming the improved surface by contacting the preliminarily improved surface as provided from the end of operation (II) as set forth immediately above for a secondary treatment time interval at at least one secondary treatment temperature with a secondary treatment liquid that comprises water and vanadate anions; and (IV) after completion of said secondary treatment time interval, discontinuing contact of the improved surface with the secondary treatment liquid except for any part thereof that may spontaneously remain adherent on said improved surface after completion of separation of the secondary treatment liquid from the improved surface under the influence of a force that promotes separation of liquid from the improved surface at least as strongly as does drainage under the influence of natural gravity; and, optionally, (V) rinsing with water the improved surface as provided from the end of operation (IV) as recited immediately above.

Preferably before operation (I) as described above, the solid surface to be modified has been cleaned to remove all foreign matter. Cleaning may ordinarily be accomplished by means known in the art to be suitable for the particular material(s) that constitute(s) the solid surface. For aluminum, conventional commercially available cleaners and deoxidizers are preferably used.

The polymer molecules present in the initial treatment liquid used according to the invention preferably are selected from the group consisting of materials (α) and (β) as defined below, wherein:

(α) consists of polymer molecules each of which has at least one unit conforming to the immediately following general formula (I):

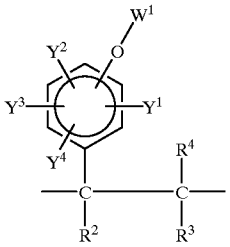

wherein:

each of $R^2$ through $R^4$ is selected, independently of each other and independently from one molecule of the component to another and from one to another unit of any polymer molecule conforming to this formula when there is more than one such unit in a single polymer molecule, from the group consisting of a hydrogen moiety, an alkyl moiety with from 1 to 5 carbon atoms, and an aryl moiety with from 6 to 18 carbon atoms; each of $Y^1$ through $Y^4$ is selected, independently of each other and independently from one molecule of the component to another and from one to another unit of any polymer molecule conforming to this formula when there is more than one such unit in a single polymer molecule, except as noted further below, from the group consistings of: a hydrogen moiety; a —$CH_2Cl$ moiety; an alkyl moiety with from 1 to 18 carbon atoms; an aryl moiety with from 6 to 18 carbon atoms; a moiety conforming to the general formula —-$CR^{12}R^{13}OR^{14}$, where each of $R^{12}$ through $R^{14}$ is selected from the group consisting of a hydrogen moiety, an alkyl moiety, an aryl moiety, a hydroxyalkyl moiety, an aminoalkyl moiety, a mercaptoalkyl moiety, and a phosphoalkyl moiety; and a moiety Z that conforms to one of the two immediately following general formulas:

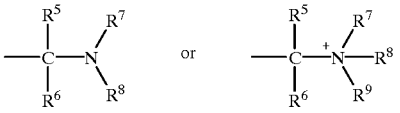

where each of $R^5$ through $R^8$ is selected, independently of each other and independently from one molecule of the component to another and from one to another unit of any polymer molecule conforming to this formula when there is more than one such unit in a single polymer molecule, from the group consisting of a hydrogen moiety, an alkyl moiety, an aryl moiety, a hydroxyalkyl moiety, an aminoalkyl moiety, a mercaptoalkyl moiety, and a phosphoalkyl moiety and $R^9$ is selected from the group consisting of a hydrogen moiety, an alkyl moiety, an aryl moiety, a hydroxy or polyhydroxy alkyl moiety, an amino or polyamino alkyl moiety, a mercapto or polymercapto alkyl moiety, a phospho or polyphosphol alkyl moiety, an $—O^-$ moiety, and an —OH moiety, at least one of $Y^1$ through $Y^4$ in at least one unit of each selected polymer molecule being a moiety Z as above defined; and $W^1$ is selected, independently from one molecule of the component to another and from one to another unit of any polymer molecule conforming to this formula when there is more than one such unit in a single polymer molecule, from the group consisting of a hydrogen moiety, an acyl moiety, an acetyl moiety, a benzoyl moiety; a 3-allyloxy-2-hydroxypropyl moiety; a 3-benzyloxy-2-hydroxypropyl moiety; a 3-butoxy-2-hydroxypropyl moiety; a 3-alkyloxy-2-hydroxypropyl moiety; a 2-hydroxyoctyl moiety; a 2-hydroxyalkyl moiety; a 2-hydroxy-2-phenylethyl moiety; a 2-hydroxy-2-alkylphenylethyl moiety; a benzyl, methyl, ethyl, propyl, unsubstituted alkyl, unsubstituted allyl, unsubstituted alkylbenzyl; halo or polyhalo alkyl, or halo or polyhalo alkenyl moiety; a moiety conforming to the general formula $—(C_xH_{2x}O)_YH$, where y is a positive integer and x, independently for each of the y $C_xH_{2x}O$ units in the moiety, represents 2 or 3; and a sodium, potassium, lithium, ammonium or substituted ammonium, or phosphonium or substituted phosphonium cation moiety; and (β) consists of polymer molecules each of which does not include a unit conforming to general formula (I) as given above but does include at least one unit corresponding to the immediately following general formula (II):

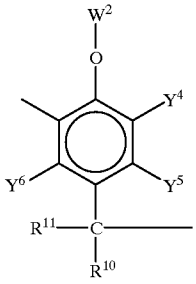

wherein:

each of $R^{10}$ and $R^{11}$ is selected, independently of each other and independently from one molecule of the component to another and from one to another unit of any polymer molecule conforming to this formula when there is more than one such unit in a single polymer molecule, from the group consisting of a hydrogen moiety, an alkyl moiety with from 1 to 5 carbon atoms, and an aryl moiety with from 6 to 18 carbon atoms;

each of $Y^4$ through $Y^6$ is selected, independently of each other and independently from one molecule of the component to another and from one to another unit of any polymer molecule conforming to this formula when there is more than one such unit in a single polymer molecule, except as noted further below, from the group consisting of: a hydrogen moiety; a $—CH_2Cl$ moiety; an alkyl moiety with from 1 to 18 carbon atoms; an aryl moiety with from 6 to 18 carbon atoms; a moiety conforming to the general formula $—CR^{12}R^{13}OR^{14}$, where each of $R^{12}$ through $R^{14}$ is selected from the group consisting of a hydrogen moiety, an alkyl moiety, an aryl moiety, a hydroxyalkyl moiety, an aminoalkyl moiety, a mercaptoalkyl moiety, and a phosphoalkyl moiety; and a moiety Z as defined for material (α) above, at least one of $Y^4$ through $Y^6$ in at least one unit of each selected polymer molecule being a moiety Z as above defined; and $W^2$ is selected, independently from one molecule of the component to another and from one to another unit of any polymer molecule conforming to this formula when there is more than one such unit in a single polymer molecule, from the group consisting of a hydrogen moiety, an acyl moiety, an acetyl moiety, a benzoyl moiety; a 3-allyloxy-2-hydroxypropyl moiety; a 3-benzyloxy-2-hydroxypropyl moiety; a 3-butoxy-2-hydroxypropyl moiety; a 3-alkyloxy-2-hydroxypropyl moiety; a 2-hydroxyoctyl moiety; a 2-hydroxyalkyl moiety; a 2-hydroxy-2-phenylethyl moiety; a 2-hydroxy-2-alkylphenylethyl moiety; a benzyl, methyl, ethyl, propyl, unsubstituted alkyl, unsubstituted allyl, unsubstituted alkylbenzyl moiety; halo or polyhalo alkyl, or halo or polyhalo alkenyl moiety; a moiety conforming to the general formula $—(C_xH_{2x}O)_YH$, where y is a positive integer and x, independently for each of the y $C_xH_{2x}O$ units in the moiety, represents 2 or 3; and a sodium, potassium, lithium, ammonium or substituted ammonium, or phosphonium or substituted phosphonium cation moiety;

the phrase "polymer molecule" in the above definitions of materials (α) and (β) including any electrically neutral molecule with a molecular weight of at least 300 daltons.

Ordinarily, primarily for reasons of economy, it is preferred to utilize as materials (α) and/or (β) predominantly molecules which consist entirely, except for relatively short end groups, of moieties conforming to one of the general formulas (I) and (II) as described above. Again primarily for reasons of economy, such materials are generally prepared by reacting homopolymers of p-vinyl phenol, for material (α), or phenol-aldehyde condensation products, for material (β), with formaldehyde and secondary amines to graft moieties Z onto some of the activated benzene rings in the materials thus reacted.

However, in some particular instances, it may be more useful to utilize more chemically complex types of materials (α) and/or (β), for example, molecules formed by reacting a condensable form of a molecule belonging to component (α) or (β) as defined above, except that the molecule reacted need not initially satisfy the requirement for component (α) or (β) that each molecule contain at least one moiety Z, with at least one other distinct type of molecule which is selected from the group consisting of phenols, tannins, novolak resins, lignin compounds, aldehydes, ketones, and mixtures thereof, in order to prepare a condensation reaction product, which optionally if needed is then further reacted with (1) an aldehyde or ketone and (2) a secondary amine to introduce at least one moiety Z as above defined to each molecule, so that the molecule can qualify as material (α) or (β).

Another example of more complex materials that can be utilized as material (α) is material in which the polymer chains are at least predominantly copolymers of simple or substituted 4-vinyl phenol with another vinyl monomer such as acrylonitrile, methacryl-onitrile, methyl acrylate, methyl methacrylate, vinyl acetate, vinyl methyl ketone, isopropenyl methyl ketone, acrylic acid, methacrylic acid, acrylamide, methacrylamide, n-amyl methacrylate, styrene, m-bromostyrene, p-bromostyrene, pyridine, diallyidimethylammonium salts, 1,3-butadiene, n-bual acbaate, 1-butylamino-ethyl methacrylate, n-butyl meth-acrylate, t-butyl methacrylate, n-butyl vinyl ether, t-butyl vinyl ether, m-chlorostyrene, o-chlorostyrene, 2-chlorostyrene, n-decyl methacrylate, N,N-diallylmelamine, N,N-di-n-butylacrylamide, di-n-butyl itaconate, di-n-butyl maleate, diethylaminoethyl methacrylate, diethylene glycol monovinyl ether, diethyl fumarate, diethyl itaconate, diethylvinyl phosphate, vinylphosphonic acid, diisobutyl maleate, diisopropyl itaconate, diisopropyl maleate, dimethyl fumarate, dimethyl itaconate, dimethyl maleate, di-n-nonyl fumarate, di-n-nonyl maleate, dioctyl fumarate, di-n-octyl itaconate, di-n-propyl itaconate, N-dodecyl vinyl ether, acidic ethyl fumarate, acidic ethyl maleate, ethyl acrylate, ethyl cinnamate, N-ethyl methacrylamide, ethyl methacrylate, ethyl vinyl ether, 5-ethyl-2-vinylpyridine, 5-ethyl-2-vinylpyridine-1-oxide, glycidyl acrylate, glycidyl methacrylate, P-hexyl methacrylate, 2-hydroxyethyl methacrylate, 2-hydroxypropyl methacrylate, isobutyl methacrylate, isobutyl vinyl ether, isoprene, isopropyl methacrylate, isopropyl vinyl ether, itaconic acid, lauryl methacrylate, methacrylamide, methacrylic acid, methacrylonitrile, N-methylolacrylamide, N-methylolmethacrylarnide, N-isobutoxymethylacrylamide, N-isobutoxy-methylmethacrylamide, N-alkyloxymethylacrylamide, N-alkyloxymethylmethacrylamide, N-vinylcaprolactam, methyl acrylate, N-methylmethacrylamide, a-methylstyrene, m-methyistyrene, o-methylstyrene, p-methylstyrene, 2-methyl-5-vinylpyridine, n-propyl methacrylate, sodium p-styrene-sulfonate, stearyl methacrylate, styrene, p-styrenesulfonic acid, p-styrenesulfonamide, vinyl bromide, 9-vinyl carbazole, vinyl chloride, vinylidene chloride, 1 -vinyinaphthalene, 2-vinylnaphthalene, 2-vinylpyridine, 4-vinylpyridine, 2-vinylpyridine N-oxide, 4-vinylpyrimidine, and N-vinylpyrrolidone.

The following preferences, primarily for reasons of economy, improved corrosion resistance, and/or increased water solubility, apply independently for each perference to the molecules of materials (α) and (β):

each of $R^2$ through $R^6$, $R^{10}$, $R^{11}$, $W^1$, and $W^2$, independently for each and from one unit to another in the same or a different molecule, preferably is a hydrogen moiety;

each of $Y^1$ through $Y^6$, independently for each and from one unit to another in the same or a different molecule, preferably is a hydrogen moiety or a moiety Z;

each polymer molecule contains a number of units corresponding to one of general formulas (I) and (II) as defined above that is at least, with increasing preference in the order given, 2, 3, 4, 5, 6, 7, or 8 and independently preferably is not more than 100, 75, 50, 40, 30, or 20;

in the total of materials (α) and (β) in a composition used in operation (II) according to the invention, the number of moieties Z has a ratio to the number of aromatic nuclei that is at least, with increasing preference in the order given, 0.01:1.0, 0.03:1.0, 0.05:1.0, 0.10:1.0, 0.20:1.0, 0.40:1.0, 0.50:1.0, 0.60:1.0, 0.70:1.0, 0.80:1.0, 0.90:1.0, or 0.95:1.0 and independently preferably is not more than, with increasing preference in the order given, 2.0:1.0, 1.6:1.0, 1.50:1.0, 1.40:1.0, 1.30:1.0, 1.20:1.0, 1.10:1.0, or 1.00:1.0; and in the total of materials (α) and (β) in a composition used in operation (II) according to the invention, the number of "polyhydroxy moieties Z", has a ratio to the total number of moieties Z in the composition that is at least, with increasing preference in the order given, 0.10:1.0, 0.20:1.0, 0.30:1.0, 0.40:1.0, 0.50:1.0, 0.60:1.0, 0.70:1.0, 0.80:1.0, 0.90:1.0, or 0.98:1.0; for this purpose "polyhydroxy moietes Z" are defined as moieties Z in which at least one of $R^5$ through $R^8$ in the general formulas given above for moieties Z has (i) from 3 to 8, or preferably from 4 to 6, carbon atoms and (ii) as many hydroxyl groups, each attached to one of the carbon atoms, as one less than the number of carbon atoms in the $R^5$ through $R^8$ moiety.

Poly(5-vinyl-2-hydroxy-N-benzyl)-N-methylglucamine is a specific polymer of the most preferred type, which, in the acidic pH range which is preferred as described below, is present at least in part as an ammonium salt.

Independently of other preferences for the dissolved, dispersed, or both dissolved and dispersed polymers that include substantial mass fractions of benzene rings that are substituted with at least one oxygen atom and at least one substituted aminomethylene moiety on each ring and that are present in the initial liquid treatment composition used in a process according to this invention, the mass of the total of all units in these polymers that conform to one of the general formulas (I) and (II) as described above preferably has a ratio to the total mass of the polymers that is at least, with increasing preference in the order given, 0.05:1.0, 0.10:1.0, 0.15:1.0, 0.20:1.0, 0.25:1.0, 0.30:1.0, 0.35:1.0, 0.40:1.0, 0.45:1.0, or 0.50:1.0.

Aqueous solutions, dispersions, or both solutions and dispersions of the polymers that constitute a necessary component of an initial treatment liquid for use in operation (I) as defined above in a process according to this invention can be prepared by means previously known in the art and described in one or more of the following U.S. Patents, the entire disclosures of which, except to the extent that they may be contrary to any explicit statement herein, are hereby incorporated herein by reference: U.S. Pat. No. 5,039,770 of Aug. 13, 1991; U.S. Pat. No. 5,116,912 of May 26, 1992; U.S. Pat. No. 5,266,410 of Nov. 30, 1993; U.S. Pat. No. 5,298,289 of Mar. 29, 1994; U.S. Pat. No. 4,963,596 of Oct. 16, 1990; U.S. Pat. No. 5,068,299 of Nov. 26, 1991; U.S. Pat. No. 4,970,264 of Nov. 13, 1990; U.S. Pat. No. 5,063,089 of Nov. 5, 1991; U.S. Pat. No. 4,517,028 of May 14, 1985; and 4,433,015 of Feb. 21, 1984, all to Lindert et al. However, all of these patents teach the use of solvents as part of the preparation of the polymers desired. It has recently been found that very similar polymers can be made without use of significant amounts of solvents, and polymers of this latter type are preferred for use in an initial treatment liquid used according to this invention. Processes for making this type of polymers are described in detail in U.S. Pat. No. 5,891,952 of Apr. 6, 1999, the entire disclosure of which, except to any extent that it may be contrary to any explicit description herein, is hereby incorporated herein by reference. Some of the pertinent disclosures from this application are set forth below.

Aqueous solutions of such polymers are products of reaction among:

(A) precursor polymer molecules, each of which comprises at least two benzene rings, each of which benzens rings bears at least one substituent moiety that comprises a hydroxyl moiety bonded directly to a carbon atom of the benzene ring;

(B) molecules of at least one material selected from the group consisting of aldehydes and ketones; and (C) molecules of at least one primary or secondary amine. A process of making such a material comprises the following operations:

(I') reacting the phenolic polymer or copolymer, component (A), in water with an organic or inorganic base to form the corresponding phenoxide salt;

(II') reacting the aqueous solution from operation (I') with the amine, component (C), and the aldehyde, ketone, or mixture thereof, component (B), at a temperature within the range from 20to 100° C., preferably from 50 to 80° C.;

(Ill') adding an acid to neutralize the base and to react with the amine functionality in the product to solubilize the product; and (IV') passing the resulting aqueous solution from operation (III') through an acid cation exchange column in its acid form to exchange cations, such as sodium ions, from the organic or inorganic base. If it is desired to also remove unreacted secondary amine as well, as is normally preferred, a strong acid cation exchange column is preferably used. If it is desired to remove only base cations, a weak acid cation exchange column is preferably used.

The primary reaction in operation (II') is believed to be to graft, onto at least some of the benzene rings in component (A), moieties that conform to the first of the formulas for a moiety Z already given above. The moieties $R^7$ and $R^8$ will be those that were in the amine(s) used. Moieties Z that conform to the second of the possible formulas for these moieties already given above may be obtained by oxidation of the first type of Z moiety, for example with hydrogen peroxide, to introduce an $—O^-$ moiety as $R^9$. In either instance, $R^5$ and $R^6$ will be the moieties attached to the carbonyl carbon in the aldehyde(s) and/or ketone(s) used.

The quantities of components (A), (B), and (C) used to prepare the substituted polyphenol polymer product in aqueous solution are generally from about 0.25 to about 2.0 molecular equivalents of component (B) and from about 0.25 to about 2.0 molecular equivalents of component (C), each based on 1.0 molecular equivalent of benzene rings in component (A). The absolute quantities of these components are selected to provide an aqueous solution from operation (IV') that contains from 5 to 50, preferably from 15 to 35, % by weight of solids in the solution. Viscosity considerations may of course limit the upper concentration of any particular product.

In operation (I') the organic or inorganic base is preferably an alkali metal hydroxide, e.g. sodium or potassium hydroxide, although tetraalkylammonium hydroxides, e.g. tetrabutylammonium hydroxide, or tetraarylammonium hydroxides can also be used. The base shalild be present in at least 10 mole %, and preferably at least 25 mole %, based on *.he phenolic polymer or copolymer.

Operation (I') is preferably carried out at a temperature in the range of from 20 to 50° C., more preferably from,20 to 25° C.

In operation (III') the acid used to neutralize the base can be organic or inorganic. Suitable acids for this purpose include carbonic acid, acetic acid, citric acid, oxalic acid, ascorbic acid, phenylphosphonic acid, chloromethylphosphonic acid; mono-, di- and tri-chloroacetic acid, trifluoroacetic acid, nitric acid, phosphoric acid, hydrofluoric acid, sulfuric acid, boric acid, hydrochloric acid, fluorometallic acids, and the like. The most preferred acids are the fluorometallic acids, specifically fluorosilicic, fluorotitanic, and fluorozirconic acids, with perferences among these acids as specified below.

For operation (IV'), preferred strong acid cation exchange columns are those of the sulfonic acid or phosphonic acid types. Preferred weak acid cation exchange columns are those of the carboxylic acid type.

Component (A), the precursor phenolic or substituted phenolic polymer or copolymer, is preferably selected so as to result after reaction in a preferred type of polymer for the initial treatment liquid as already described above.

The molecular weight of component A can be in the range of 360 to 30,000 or greater. Preferred component (A) is poly (4-vinylphenol) having a molecular weight of from 2500 to 10,000, more preferably from 4,500 to 6,000.

Component (B) is preferably an aldehyde, and most preferably is formaldehyde, especially in the form of paraformaldehyde. Formaldehyde is generally commercially available in a form that contains a significant quantity of methanol, e.g. 15% methanol. Since the present process is carried out in the absence of organic solvents, formaldehyde free from methanol should be used, such as uninhibited aqueous formaldehyde. Paraformaldehyde is also a convenient form of formaldehyde that does not contain any alcohol component.

Component (C) is an amine, preferably a secondary amine, e.g. methylethylamine, dirnethylamine, diethylamine, diethanolamine, dipropylamine, di-n-butylamine, diisoamylamine, dibenzylamine, methyldiethylethylenediamine, methylaniline, piperidine, 1,2,3,4-tetrahydroisoquinoline, 6-methoxy-1,2, 3,4-tetrahydroisoquinoline, morpholine, piperazine, α-methylaminopropiophenone, α-acetylethylbenzylamine; benzyl-(2-cyclohexanonylmethyl)-amine, 3,4-methylenedioxybenzyl-(2-cyclohexanonylmethyl) -amine, N-meihylglucamnine, glucosamine, and t-butylamine; or mixtures thereof. Primary amines, such as $C_1$–$C_2$ alkyl amines and the like, can also be used.

An optional further operation (V') can be employed if it is desired, as is generally preferred, to add a fluormetallic acid to the composition. Operation (V') is carried out by adding to the composition from operation (IV') a fluorometallic acid, e.g. fluorotitanic acid ($H_2TiF_6$), fluorosilicic acid ($H_2SiF_6$), fluorozirconic acid ($H_2ZrF_6$), and the like, generally in an amount from about 0.01 to about 5.0% by weight, based on the weight of the final aqueous composition. The solution can then again be passed through an acid cation exchange column.

In an initial treatment liquid used in a process according to the invention, the total mass of dissolved, dispersed, or both dissolved and dispersed polymers that include substantial mass fractions of benzene rings that are substituted with at least one oxygen atom and at least one substituted aminomethylene moiety on each ring preferably constitutes a fraction, referred to the total mass of the initial treatment liquid, that is at least, with increasing preference in the order given, 0.01, 0.03, 0.05, 0.07, 0.09, 0.11, 0.13, 0.15, 0.17, or 0.19% and independently preferably, primarily for reasons of economy, is not more than, with increasing preference in the order given, 10, 8, 6, 4, 2, 1.0, 0.80, 0.70, 0.60, 0.50, 0.45, 0.40, 0.35, 0.30, 0.28, 0.26, 0.24, or 0.22%.

An initial treatment liquid according to the invention preferably has a pH value that is at least, with increasing preference in the order given, 1.0, 1.5, 2.0, 2.3, 2.6, 2.9, 3.1, 3.3, or 3.5 and independently preferably is not more than, with increasing preference in the order given, 6.0, 5.7, 5.4, 5.0, 4.8, 4.6, 4.4, 4.2, or 4.0. Independently, an initial treatment liquid according to the invention preferably contains dissolved substances selected from the group consisting of fluorotitanate anions (i.e., $TiF_6^{-2}$), fluorosilicate anions (i.e., $SiF_6^{-2}$), and fluorozirconate anions (i.e., $ZrF_6^{-2}$). (For purposes of this description, these ions are to be considered present in an initial treatment liquid whenever materials containing these ions, including their corresponding acids, are dissolved in the composition, irrespective of the actual degree of ionization, complex formation, or the like that may occur in the composition.) Among these materials, fluorosilicate ions are less preferred and fluorozirconate ions most preferred. The concentration of these complex fluorometallate anions in an initial treatment liquid used according to the invention preferably is at least, with increasing preference in the order given, 0.2, 0.4, 0.6, 0.8, 1.0, 1.2, 1.4, 1.6, 1.8, 2.0, or 2.2 millimoles of the anions per kilogram of total initial treatment liquid, this unit of concentration being hereinafter abbreviated as "mM/kg" and applicable to other materials as well as to these particular anions; independently, the concentration of these anions preferably is not greater than, with increasing preference in the order given, 20, 18, 16, 14, 12, 10, 8, 6, 5.0, 4.5, 4.0, or 3.5 mM/kg.

It has been found that both the pH value preferences and the fluorometallate anions concentration preferences set forth in the immediately preceding paragraph can sometimes be achieved by using acids corresponding to the fluorometallate anions to adjust the pH of neutral precursor compositions that already contain the polymer content required for an initial treatment liquid to be used according to the invention. This is preferred for both convenience and economy. However, if desired, salts containing the anions may be used instead, together with another acid to adjust the pH. Also and independently, if the pH is not at its desired value when an amount of fluorometallic acid that is sufficient to achieve the desired concentration of fluorometallate anions is present in the composition, other pH adjustment agents as known in the chemical arts generally should be added. Agents with a buffering action, such as ammonium bicarbonate, are generally preferred for this purpose.

The temperature of the initial treatment liquid and the surface being treated are both preferably maintained during the initial treatment time interval at a value that is at least, with increasing preference in the order given, 25, 27, 29, 31, 33, 35, 37, or 39 and independently preferably is not more than, with increasing preference in the order given, 90, 80, 70, 65; 60, 57, 55, 53, 51, or 49° C. Independently, the initial treatment time interval preferably is at least, with increasing preference in the order given, 5, 10, 20, 40, 45, 50, 55, 60 or 65 seconds and independently preferably is not more than, with increasing preference in the order given, 300, 200, 180, 160, 140, 120, or 110 seconds.

After completion of the initial treatment time interval as described above, the preliminarily improved surface is preferably rinsed with water to remove substantially all of any residual initial treatment liquid on the preliminarily improved surface before it is contacted with the secondary treatment liquid. Whether or not it is so rinsed, however, it preferably is not allowed to dry before being contacted with the secondary treatment liquid.

Preferred secondary treatment liquids to be used in a process according to this invention consist essentially only of water, vanadate ions, and necessary counterions for the vanadate ions. Preferably, these counterions are alkali metal and/or ammonium ions, because most other vanadates are insufficiently soluble in water. Vanadates of any degree of aggregation may be used, but decavanadates are most preferred; sodium ammonium decavanadate with the chemical formula $Na_2(NH_4)_4V_{10}O_{28}$ is currently most particularly preferred, because it is the least costly commercially available source of decavanadate ions.

The concentration of vanadium atoms present in vanadate ions in a secondary treatment liquid according to this invention preferably is, with increasing preference in the order given, at least 0.1, 0.3, 0.5, 0.7, 0.9, 1.1, 1.3, 1.5, 1.7, 1.9, 2.1, 2.5, 3.0, 4.0, 7, 12, 20, 30, 40, 45, 50, 55, 57, or 59 mM/kg and independently preferably is, with increasing preference in the order given, primarily for reasons of economy, not more than 1000, 500, 300, 200, 150, 120, 100, 90, 80, 75, 70, or 65 mM/kg.

The temperature of the secondary treatment liquid and the surface being treated are both preferably maintained during the secondary treatment time interval at a value that is at least, with increasing preference in the order given, 30, 35, 39, 43, 47, 50, 53, 55, 57, or 59 and independently preferably is not more than, with increasing preference in the order given, 90, 80, 75, 70, 65, 63, or 61° C. Independently, the secondary treatment time interval preferably is at least, with increasing preference in the order given, 5, 10, 20, 40, 50, 60, 70, 80, 90, 100, 105, 110, 115, or 119 seconds and independently preferably is not more than, with increasing preference in the order given, 300, 200, 180, 160, 140, 130, 125, or 121 seconds.

After completion of the secondary treatment time interval as described above, the improved surface is preferably rinsed with water, more preferably with deionized or similarly purified water, to remove substantially all of any residual secondary treatment liquid on the improved surface before it is dried or is contacted with any further treatment liquid. The quality of improvement of the surface achieved is not believed to depend significantly on the temperature at which drying occurs, at least if this temperature is between 20 and 100° C. However, in order to speed drying rates to a level suitable for normal commercial production speed, when a process according to this invention is being used on a substrate, such as a typical automotive radiator heat exchanger, that has numerous surfaces separated by gap widths of only about a millimeter or less, heat aided drying is normally preferred for reasons of economy. In such instances, a wet improved surface from the end of operation (IV) or (V) of a process according to the invention as recited above preferably is dried by heating to a temperature that is at least, with increasing preference in the order given, 60, 70, 75, 80, 85, 90, or 92° C. and independently preferably is not more than, with increasing preference in the order given, 130, 120, 110, 105, 100, or 95° C., the heating preferably being continued for an interval of time that is at least, with increasing preference in the order given, 1, 3, 5, 7, 10, 13, 16, or 19 minutes and independently preferably is not more than, with increasing preference in the order given, 60, 50, 45, 40, 35, 30, 25, or 21 minutes. If the improved surface is to be employed for its hydrophilic properties, without the application of any further protective coating, this heating preferably is the next operation after the secondary treatment time interval and any rinsing that follows this time interval. If the improved surface is to be further coated, it may be dried and/or heated immediately, or, if it is to be coated with a water-based protective coating treatment, may be transferred directly to contact with the liquid from which the next protective coating is to be deposited, without being either dried or heated.

Separation of either the initial or secondary treatment liquid, or preferably of both these liquids, used in a process according to the invention normally is preferably aided a by a separation force substantially stronger than that of drainage undernatural gravity. A centrifuge, blowing off with compressed air, or the like is generally employed to reduce the amount of initial and/or secondary treatment liquid that remains on the preliminarily or fully improved surface.

The invention may be further appreciated by consideration of, and illustrated but not limited by, the following examples.

PRELIMINARY EXAMPLES

Preparation of Concentrates for an Initial Treatment Liquid

To a half liter size three-neck round bottom flask equipped with an overhead stirrer, reflux condenser, nitrogen gas inlet, heating mantle and thermocouple, 197 grams of deionized water, 3.0 grams of sodium hydroxide and 59 grams of N-methyl-D-glucamine were added and mixed till dissolved. 36 grams of poly{4-hydroxy styrene} was then added with stirring. The mixture was then heated to 65° C. with stirring. After 1.5 hours of stirring at 65° C., the polymer was completely dissolved. The solution was then allowed to cool to 30° C. and 9.7 grams of 92% paraformaldehyde was added with continued stirring. The solution was mixed for 30 minutes after which the paraformaldehyde was completely dissolved. The solution was then heated with stirring to 75° C. and held for 10 hours, then allowed to cool. After the solution had cooled to about 30° C. it was transferred to a 1.5 liter beaker equipped with a stirrer, and diluted with 587 grams of deionized water. The solution was mixed and 108 grams of 20% fluorozirconic acid in water was added with stirring. The solution was then passed through an ion-exchange column containing at least 150 milliliters of Rohm and Haas IR-120+cation exchange resin. The final pH was 3.5. The sodium level was less than 1 part per million and the residual formaldehyde was 300 parts per million. This concentrate was designated "PE 1".

Two additional concentrates for initial treatment liquids were prepared in the general manner described in Example 14 of U.S. Pat. No. 5,298,289, but with varied amounts of the ingredients used there. These were designated "PE 2" and "PE 3", and the amounts of ingredients other than water used to make them are shown in Table 1. The amount of water used was adjusted to give 1000 grams total of product output from the reaction (the product output is slightly smaller than the total of ingredients input because the oxygen content of formaldehyde is volatilized during reaction).

TABLE 1

| | Grams of Ingredient Reacted to Make: | |
|---|---|---|
| Ingredient | PE2 | PE3 |
| PROPASOL ™ P solvent | 241 | 288 |
| Resin M | 108 | 162 |
| N-methyl-D-glucamine | 179 | 160 |
| 37% solution of formaldehyde in water | 74 | 65 |

OTHER EXAMPLES

The surfaces treated were those on sample sheets (panels) of one of Types 3003, 5052, or 6061 aluminum alloys, or on clad composite panels, which include hollow spaces for passage of gases and liquid as well as solid supporting structures for these spaces, as actually used in larger sizes for automotive air conditioner heat exchangers. The processing sequence for all these examples included the following operations in succession in the order shown below:

1. Cleaning by immersion of the substrate surfaces for 2 minutes (hereinafter usually abbreviated as "min") in a 5.0% solution of PARCO® Cleaner 305 Concentrate, commercially available from the Henkel Surface Technologies Div. of Henkel Corp., Madison Heights, Mich., this supplier being hereinafter usually abbreviated as "HST", this solution being maintained during use at 60° C.;
2. Rinse twice by immersion in tap water at 20±7° C. for 20 seconds (hereinafter usually abbreviated as "sec") each time.
3. Deoxidize by immersion for 2.5 min in a solution in water containing 120 milliliters of commercial 70% nitric acid in water per liter of the deoxidizer solution.
4. Rinse twice by immersion in tap water at 20±7° C. for 20 sec each time.
5. Immerse in the initial treatment liquid or a comparison therewith—see details for particular instances below. The temperature for this operation was always 49° C., and after completion of the specified contact time, liquid was vigorously shaken by hand off the substrate before rinsing began.
6. Rinse twice by immersion in tap water at 20±7° C. for 20 sec each time.
7. Immerse in the secondary treatment liquid, maintained at 60° C., for 2.0 min, then shake residual liquid off vigorously by hand.
8. Rinse twice by immersion in tap water at 20±7° C. for 20 sec each time.
9. Heat in a forced air oven maintained at 93° C. for 20 min.

After completion of this process sequence, the substrates with improved surfaces were subjected to various standardized tests and evaluations.

Further details of the processing are given in Table 2 below. In this table, the abbreviation "g/l [substance X]" means "grams of [substance X] per liter of total treatment liquid". The concentrate designated in Table 2 as "490" was made in accordance with the general directions of U.S. Pat. No. 5,356,490 column 10 lines 16–33, using the following ingredients: 692 parts of deionized water; 83.7 parts of 60% $H_2TiF_6$; 5.3 parts of amorphous fumed silicon dioxide; 14.7 parts of zirconium basic carbonate; and 204 parts of concentrate PE 2 as described above.

The improved surfaces prepared as described above were tested for corrosion in neutral salt spray (American Society for Testing and Materials, hereinafter usually abbreviated as "ASTM", Method B117) for 1008 hours, acetic acid salt spray (ASTM Method G85-85) for 504 hours, and 100% relative humidity air at 38° C. for 3024 hours (ASTM Method D2247). Some of them were also tested for equilibrium contact angle of deionized water after 250 and 500 hours of continuous exposure to running tap water flowing at a rate of 3 liters per minute into the bottom of a container with a capacity of 36 liters in which the panels were immersed and which overflowed from its top. Results are shown below in Tables 3 through 5 for substrates of Types 3003, 5052, and 6061 respectively.

The results in Tables 3–5 indicate that initial treatment with a mixture of fluorozirconic acid and a resin with a molar ratio of aminomethylene substituents to benzene rings that is from about 0.6:1 to about 1:1 (Concentrates PE 1 and PE 3 as used) gives the best results. Resin made without solvent (Concentrate PE 1) is at least slightly better in some but not all instances. Mixtures that do not include fluorozirconic acid (Concentrates PE 2 and "490") give less satisfactory results, even with zirconium cations and silica added (Concentrate "490") or with other sources of fluoride present (Concentrates PE 2 and "490"). A lower concentration of vanadate in the secondary treatment liquid gave several poorer results than did a higher concentration, but the difference is relatively slight in most instances and there is no difference at all in some instances.

TABLE 2

| Process Identification Number | Characteristics of the Initial Treatment Operation: Characteristics of the Initial Treatment Liquid: Concentrate | Concentration of Concentrate in Treatment Liquid | pH Value | Initial Treatment Time, Min | Concentrations in the Secondary Treatment Liquid of: Sodium Ammonium Decavanadate, % | Other |
|---|---|---|---|---|---|---|
| 1 | PE 1 | 2.0%; Note 1 | 3.6 | 2.0 | 0.30 | none |
| 2 | PE 1 | 2.0%; Note 1 | 3.6 | 2.0 | 0.01 | none |
| 3 | PE 1 | 2.0%; Note 1 | 3.6 | 2.0 | 0.01 | 5 g/l $NaClO_3$ |
| 4 | PE 2 | 6.7 g/l; Note 2 | 3.5 | 2.0 | 0.30 | none |
| 5 | PE 3 | 6.7 g/l; Note 3 | 3.6 | 1.0 | 0.30 | none |
| 6 | PE 3 | 6.7 g/l; Note 3 | 3.6 | 1.0 | 0.30 | none |
| 7 | "490" | 2.0%; Note 4 | 3.1 | 2.0 | 0.30 | none |

Notes for Table 2
Note 1: This initial treatment liquid also contained 0.16 g/l of ammonium bicarbonate to adjust the pH.
Note 2: This initial treatment liquid also contained 0.15 g/l of HF.
Note 3: This initial treatment liquid also contained 0.76 g/l $H_2ZrF_6$.
Note 4: This initial treatment liquid also contained 0.37 g/l ammonium bicarbonate to adjust the pH.

TABLE 3

TEST RESULTS ON TYPE 3003 ALUMINUM ALLOY SUBSTRATES

| Process Identification Number | Results After Test Exposure to: Neutral Salt Spray | Acetic Acid Spray | Humidity | Contact Angle, Degrees, After: 250 Hours | 500 hours |
|---|---|---|---|---|---|
| 1 | 10% Discolored with tiny pits | 30% Pitted with medium sized pits | No corrosion or discoloration | 10 | 11 |
| 2 | 10% Discolored with tiny pits | 30% Pitted with medium sized pits | 1% Discolored, remainder very slightly discolored | Not measured | Not measured |
| 3 | 10% Discolored with tiny pits | 40% Pitted with medium sized pits | 10% Discolored, 1% white, remainder very slightly discolored | Not measured | Not measured |
| 4 | White; 30% tiny pits | 70% Pitted with large pits | 100% Discolored | Not measured | Not measured |
| 5 | Discolored; 30% tiny pits | 45% Pitted with medium size pits | 25% Discolored | Not measured | Not measured |
| 6 | Discolored, 30% tiny pits | 35% Pitted with medium sized pits | 15% Discolored | Not measured | Not measured |
| 7 | 10% Discolored; 10% tiny pits | 40% Pitted with medium sized pits | 5% Discolored | 12 | 10 |

TABLE 4

TEST RESULTS ON TYPE 5052 ALUMINUM ALLOY SUBSTRATES

| Process Identification Number | Results After Test Exposure to: Neutral Salt Spray | Acetic Acid Spray | Humidity | Contact Angle, Degrees, After: 250 Hours | 500 hours |
|---|---|---|---|---|---|
| 1 | 20% Discolored | 5% Pitted with small pits | No corrosion or discoloration | 9 | 11 |

TABLE 4-continued

TEST RESULTS ON TYPE 5052 ALUMINUM ALLOY SUBSTRATES

| Process Identification Number | Results After Test Exposure to: Neutral Salt Spray | Acetic Acid Spray | Humidity | Contact Angle, Degrees, After: 250 Hours | 500 hours |
|---|---|---|---|---|---|
| 2 | 50% Discolored; 1% pitted with tiny pits | 5% Pitted with small pits | No corrosion or discoloration | Not measured | Not measured |
| 3 | 90% White | 5% Pitted with small pits | No corrosion or discoloration | Not measured | Not measured |
| 4 | 50% White | 20% Pitted with medium pits | 100% Discolored | Not measured | Not measured |
| 5 | 30% Discolored; 5% tiny pits | 5% Pitted with medium size pits | 30% Discolored | Not measured | Not measured |
| 6 | 20% Discolored; 5% tiny pits | 5% Pitted with medium sized pits | 1% Discolored | Not measured | Not measured |
| 7 | 100% Discolored | 10% Pitted with small pits | 2% Discolored; remainder very slightly discolored | 7 | 9 |

TABLE 5

TEST RESULTS ON TYPE 6061 ALUMINUM ALLOY SUBSTRATES

| Process Identification Number | Results After Test Exposure to: Neutral Salt Spray | Acetic Acid Spray | Humidity | Contact Angle, Degrees, After: 250 Hours | 500 hours |
|---|---|---|---|---|---|
| 1 | 80% Discolored; 25% with tiny pits | 40% Pitted with medium sized pits | 5% Discolored | 5 | 11 |
| 2 | 80% Discolored; 25% with tiny pits | 45% pitted with medium sized pits | 1% Darkened; remainder very slight discoloration | Not measured | Not measured |
| 3 | 80% Discolored; 25% with tiny pits | 45% Pitted with medium sized pits | 4% Discolored, 2% white, remainder very slightly discolored | Not measured | Not measured |
| 4 | 90% White | 80% Pitted with medium pits | 100% Discolored | Not measured | Not measured |
| 5 | 80% Discolored; 50% with tiny pits | 40% Pitted with medium size pits | 80% Discolored | Not measured | Not measured |
| 6 | 80% Discolored; 50% with tiny pits | 40% Pitted with medium sized pits | 30% Discolored | Not measured | Not measured |
| 7 | 90% Discolored; 25% with tiny pits | 50% Pitted with medium sized pits | No corrosion or discoloration | 10 | 16 |

The invention claimed is:

1. A process for treating a solid metallic surface so as to transform said solid metallic surface to an improved surface, said process comprising the operations of:

(I) forming a preliminarily improved surface from said solid surface by contacting said solid surface for an initial treatment time interval at at least one initial treatment temperature with an initial treatment liquid that comprises water and dissolved, dispersed, or both dissolved and dispersed polymer molecules that include substituted benzene rings that have as substituents on each ring (i) at least one oxygen atom and (ii) at least one substituted methylene moiety that in addition to its direct bond to the benzene ring is also bonded to an N-substituted amino moiety;

(II) after completion of the initial treatment time interval, discontinuing contact of the preliminarily improved surface with the initial treatment liquid except for any part thereof that may spontaneously remain adherent on said preliminarily improved surface after completion of separation of the initial treatment liquid from the preliminarily improved surface under the influence of a force that promotes separation of liquid from the preliminarily improved surface at least as strongly as does drainage under the influence of natural gravity and, optionally, rinsing the preliminarily improved surface with water;

(III) forming the improved surface by contacting the preliminarily improved surface as provided from the end of operation (II) as set forth immediately above for a secondary treatment time interval at at least one secondary treatment temperature with a secondary treatment liquid that comprises water and vanadate anions; and (IV) after completion of said secondary treatment time interval, discontinuing contact of the improved surface with the secondary treatment liquid except for any part thereof that may spontaneously remain adherent on said improved surface after completion of separation of the secondary treatment liquid from the improved surface under the influence of a force that promotes separation of liquid from the improved surface at least as strongly as does drainage under the influence of natural gravity.

2. A process according to claim 1, wherein said initial treatment liquid comprises at least 0.05% by weight of polymer molecules selected from the group consisting of materials (α) and (β) as defined below, wherein:

(α) consists of polymer molecules each of which has at least one unit conforming to the immediately following general formula (I):

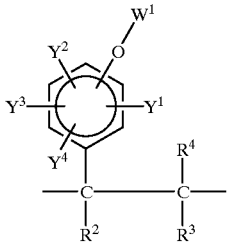

wherein:

each of $R^2$ through $R^4$ is selected, independently of each other and independently from one molecule of the component to another and from one to another unit of any polymer molecule conforming to this formula when there is more than one such unit in a single polymer molecule, from the group consisting of a hydrogen moiety, an alkyl moiety with from 1 to 5 carbon atoms, and an aryl moiety with from 6 to 18 carbon atoms;

each of $Y^1$ through $Y^4$ is selected, independently of each other and independently from one molecule of the component to another and from one to another unit of any polymer molecule conforming to this formula when there is more than one such unit in a single polymer molecule, except as noted further below, from the group consisting of: a hydrogen moiety; a —$CH_2Cl$ moiety; an alkyl moiety with from 1 to 18 carbon atoms; an aryl moiety with from 6 to 18 carbon atoms; a moiety conforming to the general formula —$CR^{12}R^{13}OR^{14}$, where each of $R^{12}$ through $R^{14}$ is selected from the group consisting of a hydrogen moiety, an alkyl moiety, an aryl moiety, a hydroxyalkyl moiety, an aminoalkyl moiety, a mercaptoalkyl moiety, and a phosphoalkyl moiety; and a moiety Z that conforms to one of the two immediately following general formulas:

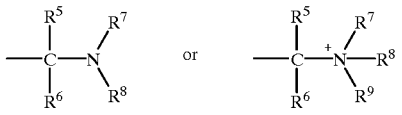

where each of $R^5$ through $R^8$ is selected, independently of each other and independently from one molecule of the component to another and from one to another unit of any polymer molecule conforming to this formula when there is more than one such unit in a single polymer molecule, from the group consisting of a hydrogen moiety, an alkyl moiety, an aryl moiety, a hydroxyalkyl moiety, an aminoalkyl moiety, a mercaptoalkyl moiety, and a phosphoalkyl moiety and $R^9$ is selected from the group consisting of a hydrogen moiety, an alkyl moiety, an aryl moiety, a hydroxy or polyhydroxy alkyl moiety, an amino or polyamino alkyl moiety, a mercapto or polymercapto alkyl moiety, a phospho or polyphospho alkyl moiety, an —$O^-$ moiety, and an —OH moiety, at least one of $Y^1$ through $Y^4$ in at least one unit of each selected polymer molecule being a moiety Z as above defined; and $W^1$ is selected, independently from one molecule of the component to another and from one to another unit of any polymer molecule conforming to this formula when there is more than one such unit in a single polymer molecule, from the group consisting of a hydrogen moiety, an acyl moiety, an acetyl moiety, a benzoyl moiety; a 3-allyloxy-2-hydroxypropyl moiety; a 3-benzyloxy-2-hydroxypropyl moiety; a 3-butoxy-2-hydroxypropyl moiety; a 3-alkyloxy-2-hydroxypropyl moiety; a 2-hydroxyoctyl moiety; a 2-hydroxyalkyl moiety; a 2-hydroxy-2-phenylethyl moiety; a 2-hydroxy-2-alkylphenylethyl moiety; a benzyl, methyl, ethyl, propyl, unsubstituted alkyl, unsubstituted allyl, unsubstituted alkylbenzyl; halo or polyhalo alkyl, or halo or polyhalo alkenyl moiety; a moiety conforming to the general formula —$(C_xH_{2x}O)_yH$, where y is a positive integer and x, independently for each of the y $C_xH_{2x}O$ units in the moiety, represents 2 or 3; and a sodium, potassium, lithium, ammonium or substituted ammonium, or phosphonium or substituted phosphonium cation moiety; and (β) consists of polymer molecules each of which does not include a unit conforming to general formula (I) as given above but does include at least one unit corresponding to the immediately following general formula (II):

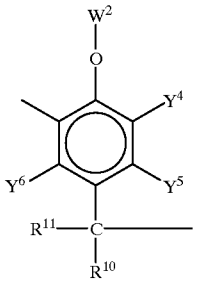

wherein:

each of $R^{10}$ and $R^{11}$ is selected, independently of each other and independently from one molecule of the component to another and from one to another unit of any polymer molecule conforming to this formula when there is more than one such unit in a single polymer molecule, from the group consisting of a hydrogen moiety, an alkyl moiety with from 1 to 5 carbon atoms, and an aryl moiety with from 6 to 18 carbon atoms;

each of $Y^4$ through $Y^6$ is selected, independently of each other and independently from one molecule of the component to another and from one to another unit of any polymer molecule conforming to this formula when there is more than one such unit in a single polymer molecule, except as noted further below, from the group consisting of: a hydrogen moiety; a —$CH_2Cl$ moiety; an alkyl moiety with from 1 to 18 carb n atoms; an aryl moiety with from 6 to 18 carbon atoms; a moiety conforming to the general formula —$CR^{12}R^{13}OR^{14}$, where each of $R^{12}$ through $R^{14}$ is selected from the group consisting of a hydrogen moiety, an alkyl moiety, an aryl moiety, a hydroxyalkyl moiety, an aminoalkyl moiety, a mercaptoalkyl moiety, and a phosphoalkyl moiety; and a moiety Z as defined for material (α) above, at least one of $Y^4$ through $Y^6$ in at least one unit of each selected polymer molecule being a moiety Z as above defined; and $W^2$ is selected, independently from one molecule of the component to another and from one to another unit of any polymer molecule conforming to this formula when there is more than one such unit in a single polymer molecule, from the group consisting of a hydrogen moiety, an acyl moiety, an acetyl moiety, a benzoyl moiety; a 3-allyloxy-2-hydroxypropyl moiety; a 3-benzyloxy-2-hydroxypropyl moiety; a 3-butoxy-2-hydroxypropyl moiety; a 3-alkyloxy-2-hydroxypropyl moiety; a 2-hydroxyoctyl moiety; a 2-hydroxyalkyl moiety; a 2-hydroxy-2-phenylethyl moiety; a 2-hydroxy-2-alkylphenylethyl moiety; a benzyl, methyl, ethyl, propyl, unsubstituted alkyl, unsubstituted allyl, unsubstituted alkylbenzyl moiety; halo or polyhalo alkyl, or halo or polyhalo alkenyl moiety; a moiety conforming to the general formula —$(C_xH_{2x}O)_yH$, where y is a positive integer and x, independently for each of the y $C_xH_{2x}O$ units in the moiety, represents 2 or 3; and a sodium, potassium, lithium, ammonium or substituted ammonium, or phosphonium or substituted phosphonium cation moiety;

the phrase "polymer molecule" in the above definitions of materials (α) and (β) including any electrically neutral molecule with a molecular weight of at least about 300 daltons.

3. A process according to claim 2, wherein:

said initial treatment liquid comprises at least 0.13% by weight of polymer molecules selected from the group consisting of materials (α) and (β);

in the molecules of materials (α) and (β):

each of $R^2$ through $R^6$, $R^{10}$, $R^{11}$, $W^1$, and $W^2$ is a hydrogen moiety;

each of $Y^1$ through $Y^6$ is a hydrogen moiety or a moiety Z;

each polymer molecule contains a number of units corresponding to one of general formulas (I) and (II) as defined above that is at least 4 and is not more than about 100;

in the total of materials (α) and (β):

the number of moieties Z has a ratio to the number of aromatic nuclei that is at least about 0.50:1.0 and is not more than about 1.20:1.0; and the number of polyhydroxy moieties Z has a ratio to the total number of moieties Z in the composition that is at least about 0.80:1.0, "polyhydroxy moieties Z" being defined as moieties Z in which at least one of $R^5$ through $R^8$ in the general formulas given above for moieties Z has:

from 3 to 8 carbon atoms and as many hydroxyl groups, each attached to one of the carbon atoms, as one less than the number of carbon atoms in the $R^5$ through $R^8$ moiety;

said initial treatment liquid has a pH value between about 2.6 and about 4.8;

said initial treatment liquid contains from about 0.8 to about 6 mM/kg of anions selected from the group consisting of fluorosilicate, fluorotitanate, and fluorozirconate anions;

said initial treatment liquid is maintained during the initial treatment time at a temperature with a range from about 31 to about 60° C.; and said initial treatment time is at least about 20 seconds.

4. A process according to claims 3, wherein said secondary treatment liquid consists essentially of water, at least about 12 mM/ kg of vanadate anions, and counterions for the vanadate anions.

5. A process according to claim 4, wherein:

the secondary treatment liquid contains at least 30 mM/kg of decavanadate anions;

the secondary treatment liquid and the surface being treated are both maintained during the secondary treatment time interval at a temperature within a range from about 43 to about 80° C.; and the secondary treatment time interval is at least about 60 seconds.

6. A process according to claim 2, wherein said secondary treatment liquid consists essentially of water, at least about 12 mM/kg of vanadate anions, and counterions for the vanadate anions.

7. A process according to claim 6, wherein:

the secondary treatment liquid contains at least 30 mM/kg of decavanadate anions;

the secondary treatment liquid and the surface being treated are both maintained during the secondary treatment time interval at a temperature within a range from about 43 to about 80° C.; and the secondary treatment time interval is at least about 60 seconds.

8. A process according to claim 1, wherein said secondary treatment liquid consists essentially of water, at least about 12 mM/kg of vanadate anions, and counterions for the vanadate anions.

9. A process according to claim 8, wherein:

the secondary treatment liquid contains at least 30 mM/kg of decavanadate anions;

the secondary treatment liquid and the surface being treated are both maintained during the secondary treatment time interval at a temperature within a range from about 43 to about 80° C.; and the secondary treatment time interval is at least about 60 seconds.

10. A process according to claim 1, wherein the surface treated is a metallic surface that contains at least about 50 atomic percent of aluminum.

11. A process for treating a solid metallic surface so as to transform said solid metallic surface to an improved surface, said process comprising the operations of:

(I) forming a preliminarily improved surface from said solid surface by contacting said solid surface for an initial treatment time interval at at least one initial treatment temperature with an initial treatment liquid that has been made by a process comprising at least the following operations:

(I') reacting precursor polymer molecules, each of which comprises at least two benzene rings, each of which benzene rings bears at least one hydroxyl moiety bonded directly to a carbon atom of the benzene ring, in water with an organic or inorganic base to form the corresponding phenoxide salt;

(II') reacting the aqueous solution from operation (I') with molecules of at least one primary or secondary amine and with molecules of at least one material selected from the group consisting of aldehydes and ketones at a temperature within the range from about 20 to about 100° C.;

(III') adding an acid to neutralize the base reacted in operation (I') and to react with the amine functionality in the product to solubilize the product; and (IV') passing the resulting aqueous solution from operation (III') through an acid cation exchange column in its acid form to exchange the cations from said base for hydrogen cations;

(II) after completion of the initial treatment time interval, discontinuing contact of the preliminarily improved surface with the initial treatment liquid except for any part thereof that may spontaneously remain adherent on said preliminarily improved surface after completion of separation of the initial treatment liquid from the preliminarily improved surface under the influence of a force that promotes separation of liquid from the preliminarily improved surface at least as strongly as does drainage under the influence of natural gravity and, optionally, rinsing the preliminarily improved surface with water;

(III) forming the improved surface by contacting the preliminarily improved surface as provided from the end of operation (II) as set forth immediately above for a secondary treatment time interval at at least one secondary treatment temperature with a secondary treatment liquid that has been made by dissolving in water a soluble source of vanadate anions; and (IV) after completion of said secondary treatment time interval, discontinuing contact of the improved surface with the secondary treatment liquid except for any part thereof that may spontaneously remain adherent on said improved surface after completion of separation of the secondary treatment liquid from the improved surface under the influence of a force that promotes separation of liquid from the improved surface at least as strongly as does drainage under the influence of natural gravity.

12. A process according to claim 11, wherein:

in operation (I'):

the base is an alkali metal hydroxide and is reacted in an amount that corresponds to at least about 25 mole percent, based on the precursor polymer molecules reacted; and the polymer molecules reacted are polymers of 4-vinylphenol having a molecular weight from about 2,500 to about 10,000;

in operation (II'):

the material selected from the group consisting of aldehydes and ketones is formaldehyde;

the amines reacted are secondary amines, at least about 40 number percent of the molecules of which include a moiety that has:

from 3 to 8 carbon atoms and as many hydroxyl moieties, each attached to one of the carbon atoms, as one less than the number of carbon atoms, said moiety being bonded to a nitrogen atom in the amine molecule;

the temperature during reaction is from about 50 to about 80° C.; and the amounts of polymer, formaldehyde, and amines reacted are such that the number of amine molecules has a ratio to the number of aromatic nuclei that is at least about 0.20:1.0 and is not more than about 2.0:1.0.

13. A process according to claim 12, wherein:

in operation (II'):

the amines reacted are secondary amines, at least about 80 number percent of the molecules of which include a moiety that has:

from 4 to 6 carbon atoms and as many hydroxyl moieties, each attached to one of the carbon atoms, as one less than the number of carbon atoms, said moiety being bonded to a nitrogen atom in the amine molecule;

the amounts of polymer, formaldehyde, and amines reacted are such that the number of amine molecules has a ratio to the number of aromatic nuclei in the polymer reacted that is at least about 0.50:1.0;

in operation (III'), the acid used for neutralization is phosphoric acid;

in preparing the initial treatment liquid, there is an additional operation after operation (IV') in which at least one acid selected from the group consisting of fluorotitanic, fluorosilicic, and fluorozirconic acids is added to the solution from the end of operation (IV') in an amount such that the resulting initial treatment liquid has a pH value between about 2.6 and about 4.8 and contains from about 0.8 to about 6 mM/kg of anions selected from the group consisting of fluorosilicate, fluorotitanate, and fluorozirconate anions;

said initial treatment liquid is maintained during the initial treatment time at a temperature with a range from about 31 to about 60° C.; and said initial treatment time is at least about 20 seconds.

14. A process according to claim 13, wherein said secondary treatment liquid has been made by dissolving in water a source of vanadate anions in an amount sufficient to provide at least about 12 mM/kg of vanadate anions in the secondary treatment liquid.

15. A process according to claim 14, wherein:

the secondary treatment liquid has been made by dissolving in water a source of decavanadate anions in an amount sufficient to provide at least 30 mM/kg of decavanadate anions in the gecondary treatment liquid;

the secondary treatment liquid and the surface being treated are both maintained during the secondary treatment time interval at a temperature within a range from about 43 to about 80° C.; and the secondary treatment time interval is at least about 60 seconds.

16. A process according to claim 12, wherein said secondary treatment liquid has been made by dissolving in water a source of vanadate anions in an amount sufficient to provide at least about 12 mM/kg of vanadate anions in the secondary treatment liquid.

17. A process according to claims 16, wherein:

the secondary treatment liquid has been made by dissolving in water a source of decavanadate anions in an amount sufficient to provide at least 30 mM/kg of decavanadate anions in the secondary treatment liquid;

the secondary treatment liquid and the surface being treated are both maintained during the secondary treatment time interval at a temperature within a range from about 43 to about 80° C.; and the secondary treatment time interval is at least about 60 seconds.

18. A process according to claim 11, wherein said secondary treatment liquid has been made by dissolving in water a source of vanadate anions in an amount sufficient to provide at least about 12 mM/kg of vanadate anions in the secondary treatment liquid.

19. A process according to claim 18, wherein:

the secondary treatment liquid has been made by dissolving in water a source of decavanadate anions in an amount sufficient to provide at least 30 mM/kg of decavanadate anions in the secondary treatment liquid;

the secondary treatment liquid and the surface being treated are both maintained during the secondary treatment time interval at a temperature within a range from about 43 to about 80° C.; and the secondary treatment time interval is at least about 60 seconds.

20. A process according to claim 11, wherein the surface treated is a metallic surface that contains at least about 50 atomic percent of aluminum.

* * * * *

UNITED STATES PATENT AND TRADEMARK OFFICE

CERTIFICATE OF CORRECTION

PATENT NO. : 6,368,671 B1
DATED : April 9, 2002
INVENTOR(S) : David R. McCormick It is certified that error appears in the above-identified patent and that said Letters Patent is hereby corrected as shown below:

Title page,
Below "Inventors" and above "Appl. No.:", please insert therefore -- Assignee: Henkel Corporation, Gulph Mills, PA. --

Signed and Sealed this

Third Day of December, 2002

JAMES E. ROGAN
*Director of the United States Patent and Trademark Office*